United States Patent [19]

Howarth

[11] 3,972,823

[45] Aug. 3, 1976

[54] SOAP COMPOSITIONS FOR NON-GELLING SOAP SOLUTION

[75] Inventor: Eric Howarth, Derby, England

[73] Assignee: H. Kohnstamm & Company, New York, N.Y.

[22] Filed: Jan. 17, 1974

[21] Appl. No.: 434,054

Related U.S. Application Data

[63] Continuation-in-part of Ser. No. 150,161, June 4, 1971, abandoned.

[52] U.S. Cl. ..... 252/132; 252/108; 252/173; 252/367; 252/368; 252/DIG. 14

[51] Int. Cl.[2] ..... C11D 9/26; C11D 9/48; C11D 10/06; C11D 17/08

[58] Field of Search ..... 252/108, 132, 318, 367, 252/368, 369, 370, 173, DIG. 14

[56] References Cited

UNITED STATES PATENTS

| | | | |
|---|---|---|---|
| 1,257,545 | 2/1918 | Starrels | 252/108 |
| 2,300,416 | 11/1942 | Grondal | 260/417 |
| 2,740,760 | 4/1956 | Pilch | 252/132 |
| 2,980,629 | 4/1961 | Lambert | 252/108 X |
| 3,576,749 | 4/1971 | Megson | 252/132 |
| 3,694,367 | 9/1972 | Peters | 252/132 X |

FOREIGN PATENTS OR APPLICATIONS

| | | | |
|---|---|---|---|
| 1,059,089 | 2/1967 | United Kingdom | 252/108 |

*Primary Examiner*—Dennis L. Albrecht

[57] ABSTRACT

A soap composition which when admixed with water forms a liquid aqueous soap solution that will not solidify or gel upon cooling. The preferred composition comprises a minor amount of a blend from about 50 to 95 percent by weight of a dry neutral alkali metal soap of a fatty acid of a minimum titre of 42°C. and a major amount of water. A preferred fatty acid is stearic acid which acts upon the concentrated soap solution to prevent gellation of the same upon cooling.

4 Claims, No Drawings

SOAP COMPOSITIONS FOR NON-GELLING SOAP SOLUTION

RELATED CASES

This present application is a continuation-in-part application of application Ser. No. 150,161 filed June 4, 1971 now abandoned.

DEFINITION OF TERMS

Where the terms "a major amount of" is employed this is intended to refer to a quantity of from 50.1 to 99.9% of the ingredient by total weight of the composition. Conversely the terms "a minor amount of" is defined to refer to a quantity of from 0.1 to 49.9% of the ingredient by total weight of the same.

BACKGROUND OF THE INVENTION

It is established practice in many large commercial laundries to use a "Central Liquid Supply System". With this system all washing chemicals such as soap, alkali, bleach, sour, softener, etc., are made up at a central location as stock solutions and are then pumped through pipes to the various washwheels, where they are measured or metered into the washing machines according to a programmed sequence.

One of the more important chemicals used in this operation is the soap. This product is purchased as a dry flake or powder and is dissolved in a tank with the aid of heat and agitation. Live steam is often used for this purpose. It is desirable to obtain as concentrated a soap solution as is feasible for a higher concentration leads to economies in time and size of the pipes and tanks.

A serious drawback to this central supply system is the tendency of the stock soap solution to gel. When gellation occurs in the stock tank it is difficult and time-consuming to bring it back to a liquid state because the stirrer usually cannot move the gelled mass while it is being heated. If gellation occurs in the pipes and conduits it is an even more difficult process to unclog and clean them. When gellation sticks valves, it throws the system completely off and this condition is still more laborious to correct.

To help overcome the tendency of the soap solution to gel, the laundry operator will use all or a combination of any of the following precautionary procedures. He will prepare a less concentrated solution, keep the solution hot at all times, have a heating system on all the conduits, have a closed loop delivery so that when the soap is not being delivered to a washwheel, it is constantly re-circulated. Despite these precautions, due to human error, or mechanical failure, gellation still occurs and is a problem in this system.

It has been suggested in the past to prepare germicidal liquid castor oil soaps which, if they become gelled or saponified, may be partially restored to the liquid state by subjection of the gel to the application of heat and free fatty acids derived from castor oil such as ricinoleic acid. However, there has not heretofore been described a soap composition in dry form which when put into solution in water at a high concentration using agitation and heat would not gel upon standing and cooling. Such a composition would be of considerable value to the laundry industry.

It is an object of the present invention, therefore, to describe a method for preparing and using such a soap composition which overcomes all the above noted deficiencies of the prior art and has new properties of stability never before appreciated. The following description of the invention will set forth the means which must be taken to attain this object and the invention will be further illustrated by reference to a preferred mode of practice of the technique for making and using the soap composition described and claimed.

BRIEF DESCRIPTION OF THE INVENTION

Accordingly, the present invention comprises a composition for the preparation of a non-gelling aqueous liquid soap composition having a medium to high titre. This composition comprises a minor amount of less than 50% of a dry component containing (1) from at least about 50 to 95 percent by weight of a neutral alkali metal soap of a fatty acid, or a mixture of fatty acids selected from saturated and/or unsaturated carboxylic acids having from about $C_{12} - C_{22}$ carbon atoms therein and free fatty acid. It is understood that some of these fatty acids will be purer than others and as the purity of the fatty acid component varies, so also will the titre of the soap. In general, the higher the titre, the purer the soap as regards a single particular fatty acid from which it is made.

This question of purity is even more important when it comes to the fatty acid stabilizer component (2) which is usually added at a level of about 5 to 50 percent generally and preferably at 30% of the blend of fatty acid soap and acidic ingredient. The major amount of the soap solution in amount of more than 50% by total weight will be water. It is understood that the fatty acids used in the component (2) vary in purity and, in general, as this purity varies, so do the properties of the fatty acid. The higher titre fatty acids are more often composed of very high quantities of almost 100 percent of one particular fatty acid but these fatty acids are also more expensive to obtain and, therefore, a criterion is established for the purpose of the present invention, that the titre and hence the purity of the fatty acid stabilizer blending with the neutral soap base, must be of such purity and integrity that it is relatively free-flowing and certainly not gummy when admixed with the neutral soap base. Therefore, the product which comprises the product aspect of this invention is a liquid dilute aqueous soap which has intermittently admixed and co-mingles therein a soap mix containing from about 5 – 50 percent by weight thereof, of a dry, free-flowing, substantially saturated monocarboxylic acid having from about $C_{12}$ to $C_{22}$ carbon atoms therein. Mixtures of such fatty acids with materials which cannot influence activity of the principal ingredients, are recognized as present in the composition. In this aspect of the invention, the composition is in the form of a mechanical mixture which when ready for use, is simply added to a quantity of water, heated separately and stirred. The dry powder component made up of (1) and (2) is referred to in the Claims as (b) and comprises a minor amount of less than 10% by weight of the total liquid composition.

While the preferred practice of the invention involves, as indicated above, the use of a mechanical mixture of the ingredients to achieve a composition wherein the dry flaked fatty acid stabilizer such as stearic acid of a titre of 52°C is used, it is possible to practice a variation of the invention which takes the soap base and melts it with the fatty acid so as to fuse the two ingredients which are then solidified. One manner of such solidification would be spraying the melted soap plus the acid stabilizer into the path of a current of very cold air. Another would be to pass the melt over a chilled roller. These procedures would result in the formation of a homogeneous powder or flake having the fatty acid stabilizer melted therein.

Still a third variation on our concept involves blending from 5 to 50% of dry acidic powder component material such as rosin, sodium bisulfate, sulfamic acid, or monosodium dihydrogen phosphate with the soap base (b). These acidic materials would act to release the fatty acids to the concentrated solution of the neutral soap ingredient. Therefore, the physical embodiment of this alternative form of the invention would be a powder comprising a medium or high titre neutral soap base and an acidic component in amounts sufficient to release free fatty acid of at least 5 percent by weight. Whichever of these forms the dry soap mix would take, the underlying principle which governs all three is that where a mixture of a medium or high titre fatty acid is ultimately released to the soap concentrate upon dispersion in water, there will result at least 5 percent by weight of fatty acid stabilizer therein. This powder, therefore, will be marketed as a reconstitutable industrial soap product which can be put into water and heated to make a non-gelling liquid soap.

While the present invention chiefly concerns itself with the advantages to be gained from the use of such a novel soap it must be understood that the process of use involved in the use of the composition in an industrial cleaning soap solution is necessarily affected by the new properties imparted to the composition. For example, where a soap solution is made up containing 70 percent of total weight of a high titre neutral soap having a range of titre of about 35 – 44°C and about 25 percent by weight of a useful fatty acid such as stearic acid having a minimum titre of about 42°C, the resulting product can be employed under conditions of extreme variations in environmental temperature. The cleaning liquid prepared from this soap powder will remain in the liquid state despite cooling of the liquid, either in the holding tanks, pipelines or conduits.

In general, where a mechanical mix is employed, it is preferred to use a fatty acid of a titre of 52° – 60°C and to use a neutral soap base of a titre of about 36° – 42°C. Where a co-melted powder is prepared, it is preferred to use a fatty acid of a titre which ranges from about 42° – 48°C. and a neutral soap base of a titre of about 36° – 42°C. This will result in the final co-mixed product having a titre of about 40° – 44°C. Finally, where the acid powder replaces the dry fatty acid stabilizer, sufficient dry acid must be added to give a product having sufficient fatty acid therein to give a non-gelling solution.

While it is preferred to use a medium or high titre fatty acid which is saturated such as stearic acid, it is also within the scope of the invention to practice the same using another fatty acid as a stabilizer additive. Such saturated fatty acids as palmitic acid, lauric acid or myristic acid or mixtures of some of these, may also be employed.

As regards the medium or high titre neutral soap base it must be pointed out that a rather wide range of saop products may be equivalently substituted for this portion of the composition and while it is preferred to employ a neutral soap base made from sodium or potassium hydroxide saponification of tallow, having a titre as indicated above, it is possible to employ the other fatty acid soaps derived from a reaction of the fatty acid with a number of other alkaline materials such as potassium hydroxide, sodium carbonate and the like. In this context, it must be understood that the chemical composition of a neutral soap base such as tallow, is well known once the titre number is recited since a number of soap manufacturers publish literature which define the soap product in terms of its acid composition based on the titre. Therefore, herein we generally refer to those soaps whose fatty acids have a melting point which generally ranges between 35° – 42°C.

For the purpose of illustration of a typical saturated carboxylic acid additive, we may refer to the commercial saturated fatty acid presently available which is known commercially as "Industrene R" which is manufactured and distributed by Hemko Products. This particular stearic acid commercial product has an acid value of 193 – 205 and a titre of 52° – 60°C. Similar commercial grade stearic acid materials are also available.

As stated earlier, the basic criterion for the use of such less pure stearic acid products is that they must have a sufficiently high titre to avoid problems in free flow and friablility, since the product is to be a powderous material capable of being stored and shipped without agglomeration of the particles.

The following Example will further illustrate the practice of the present invention and although it is only intended to illustrate the concept involved herein, it may not be deemed as limiting the scope of the invention. Unless otherwise indicated, the amounts of materials employed are in percent by weight of the total composition. For a definition of the scope of the invention illustrated by the following specific embodiment, attention is directed to the several claims appended herein which define the subject matter sought to be patented.

EXAMPLE

In an example of the practice of this invention there is admixed a conventional mixer, 3 pounds of a commercially available flaked neutral sodium metal soap of a mixture of $C_{12}$ – $C_{22}$ fatty acids derived from tallow and 1 pound of a flaked stearic acid which has a titre of 53°C, an acid number of 197 and a saponification number of 199.

This dry mixture results in the formation of a soap powder which when put into water at the rate of 1 pound of powder to 31 pounds of water, forms a free-flowing solution useful for commercial laundry uses. This liquid soap composition has prolonged freedom from gellation for 19 days even though the same composition without the stabilizing flaked stearic acid additive, gelled almost immediately upon cooling.

The neutral sodium soap to tallow (titre 42°C) which is the base soap may be used without the fatty acid stabilizer at this concentration so long as the solution is kept very hot, but if this solution is permitted to cool to 60° – 70°C, it will gel.

I claim as my invention:

1. A dilute aqueous liquid non-gelling soap composition which consists of:

a. a major amount of water by weight and, b. a minor amount of less than 10% by weight of a powder dissolved therein having a titre of from 40° – 44°C said powder consisting of:

1. From at least 50 to about 95% by weight of a dry neutral alkali metal soap of a fatty acid or mixture of fatty acids having a titre of from about 36° – 42°C and, 2. from about 5 – 50% of a free fatty acid of a titre of at least 42°C having from about $C_{12}$ to $C_{22}$ Carbon atoms in the fatty acids therein, sufficient to prevent gellation and wherein the fatty acid component of the composition acts as a stabilizer for the composition when the same is further dissolved in water.

2. A composition according to claim 1 herein the fatty acid component is substantially stearic acid having a titre which ranges from 42° to 48°C.

3. A composition according to claim 1 wherein the fatty acid component (2) is stearic acid having a titre of 52° to 60°C present as a mechanical mixture with the neutral alkali metal soap component (1).

4. A composition according to claim 1 wherein the neutral alkali metal soap and the saturated free fatty acid component are intimately comingled in a molten state wherein the fatty acid component added into the melt has a titre which ranges from 42° – 48°C and the final titre of the comixed melt is about 40° – 44°C.

* * * * *